US005452497A

United States Patent [19]

Peng

[11] Patent Number: 5,452,497

[45] Date of Patent: Sep. 26, 1995

[54] MULTI-PURPOSE FIXING SEAT FOR BELTS

[76] Inventor: Jung C. Peng, P.O. Box 82-144, Taipei, Taiwan, Prov. of China

[21] Appl. No.: 159,466

[22] Filed: Nov. 30, 1993

[51] Int. Cl.[6] ..... A45F 5/00

[52] U.S. Cl. ..... 24/3.11; 24/597; 24/663; 24/669; 224/197; 224/252; 224/271

[58] Field of Search ..... 24/3 L, 3 R, 3 H, 24/3 J, 332, 334, 341, 338, 510, 505, 597, 517, 669, 663; 224/197, 271, 269, 252

[56] References Cited

U.S. PATENT DOCUMENTS

| | | | |
|---|---|---|---|
| 4,083,481 | 4/1978 | Selinko | 24/3 R X |
| 4,419,794 | 12/1983 | Horton, Jr. et al. | 24/597 X |
| 4,605,335 | 8/1986 | Otrusina | 24/3 L X |
| 5,054,170 | 10/1991 | Otrusina | 24/3 R X |
| 5,201,858 | 4/1993 | Otrusina | 24/3 R X |
| 5,274,885 | 1/1994 | Hellweg | 24/3 R |
| 5,347,093 | 9/1994 | Otrusina | 24/3 R X |

*Primary Examiner*—James R. Brittain
*Attorney, Agent, or Firm*—Alfred Lei

[57] ABSTRACT

A multi-purpose fixing seat for belts including a body portion formed with a recess having a raised rack at both sides thereof, a plurality of protuberances between two portions of the raised rack, and a circular raised edge enclosing the protuberances, a resilient member fitted between the protuberances and the circular raised edge, a cover fixedly mounted on the body portion and pivotally connected with a clamping member, the clamping member provided on the top with a movable button which is connected with a rod member at the bottom of the clamping member, the cover having a lug adapted to receive the rod member, and a fixing plate having a toothed member formed with teeth at two opposite sides and a flat surface at the other two opposite sides, the toothed member being engaged with the resilient member, whereby the fixing seat can be conveniently used to carry the mobile telephone, camera, or the like.

1 Claim, 6 Drawing Sheets

MULTI-PURPOSE FIXING SEAT FOR BELTS

BACKGROUND OF THE INVENTION

It has been found that the mobile telephone is held by the hand of the user and the camera is carried on the back of the user thereby causing much inconvenience in use.

Therefore, it is an object of the present invention to provide a multi-purpose fixing seat for belts which can facilitate the carriage of the mobile telephone, camera, or the like.

SUMMARY OF THE INVENTION

This invention relates to a multi-purpose fixing seat for belts.

It is the primary object of the present invention to provide a multi-purpose fixing seat for belts which can be conveniently connected with a calling machine.

It is another object of the present invention to provide a multi-purpose fixing seat for belts which can be easily connected with a mobile telephone.

It is still another object of the present invention to provide a multi-purpose fixing seat for belts which can be used to carry a camera.

It is still another object of the present invention to provide a multi-purpose fixing seat for belts which is simple in construction.

It is a further object of the present invention to provide a multi-purpose fixing seat for belts which is economic to produce.

Other objects and merits and a fuller understanding of the present invention will be obtained by those having ordinary skill in the art when the following detailed description of the preferred embodiment is read in conjunction with the accompanying drawings wherein like numerals refer to like or similar parts.

DETAILED DESCRIPTION OF THE PREFERRED EMBODIMENT

Figure 1:
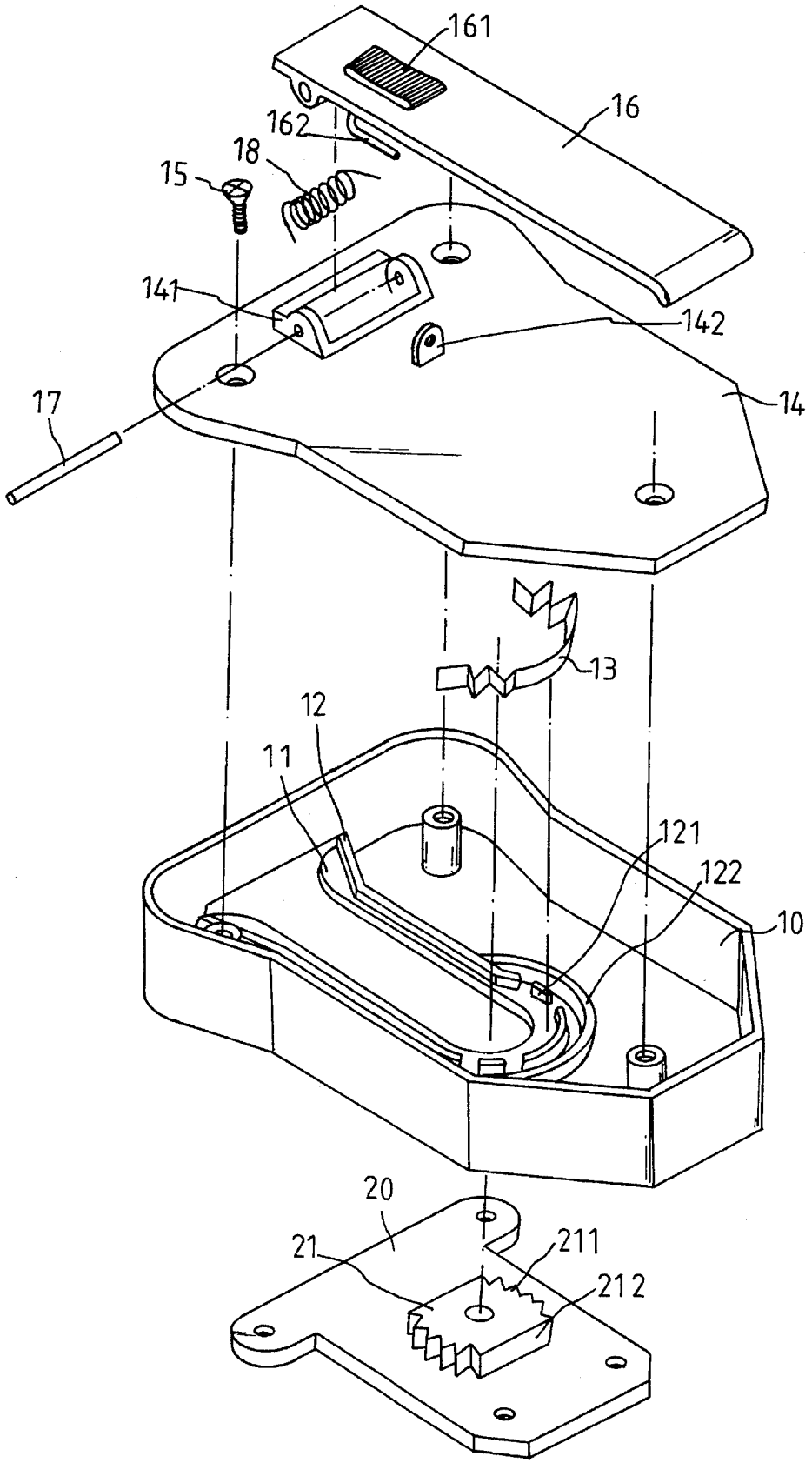
FIG. 1 is an exploded view of the present invention.

For purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

With reference to the drawings and in particular to FIG. 1 thereof, the multi-purpose fixing seat for belts mainly comprises a body portion 10, a cover 14, and a fixing plate 20. The body portion 10 is formed with a recess 11 having a raised rack 12 at both sides thereof. Between the raised racks 12 there are a plurality of protuberances 121 and a circular raised edge 122 enclosing the protuberances 121. A resilient member 13 is fitted between the protuberances 121 and the circular raised edge 122.

Figure 2A:
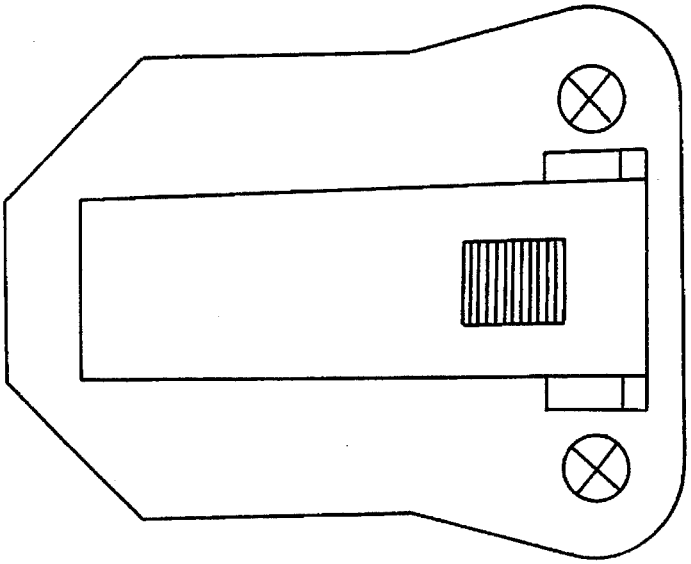
FIG. 2A is a top view of the present invention.
Figure 2B:
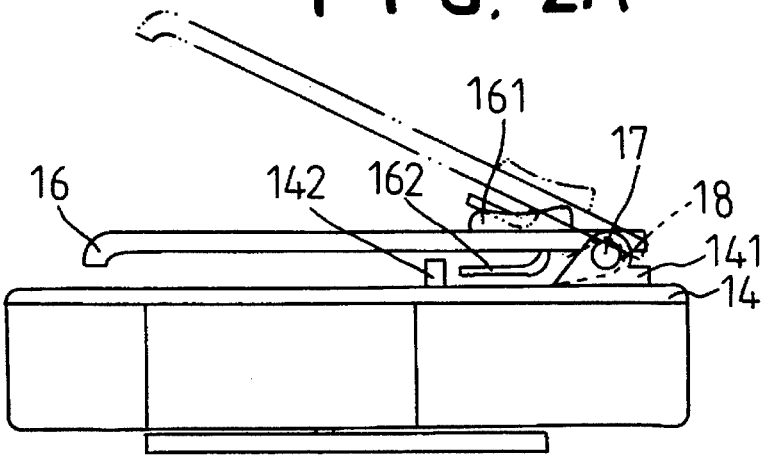
FIG. 2B shows how the clamping member works.
Figure 3:
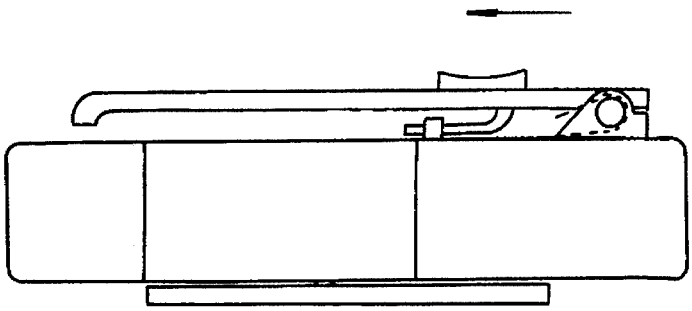
FIG. 3 shows the engagement between the rod member of the clamping member and the lug of the cover.

The cover 14 is fixedly mounted on the body portion 10 by three screws 15. The cover 14 is formed with a bracket 141 in which is fitted a spring 18. A clamping member 16 is pivotally mounted on the bracket 141 by an axle 17 extending through the bracket 14, the spring 18 and the lugs of the clamping member 16. The clamping member 16 is provided with a movable button 161 on the top. The movable button 161 is connected with a rod member 162 at the bottom side of the clamping member 16 so that the rod member 162 will be moved in unison with the movable button 161. Further, the top of the cover 14 has a lug 142 which will just receive the rod member 162 when the movable button 161 is pushed to the right (with respect to FIG. 1) thereby keeping the clamping member 16 in a fixed position (see FIGS. 2A, 2B and 3).

Figure 4:
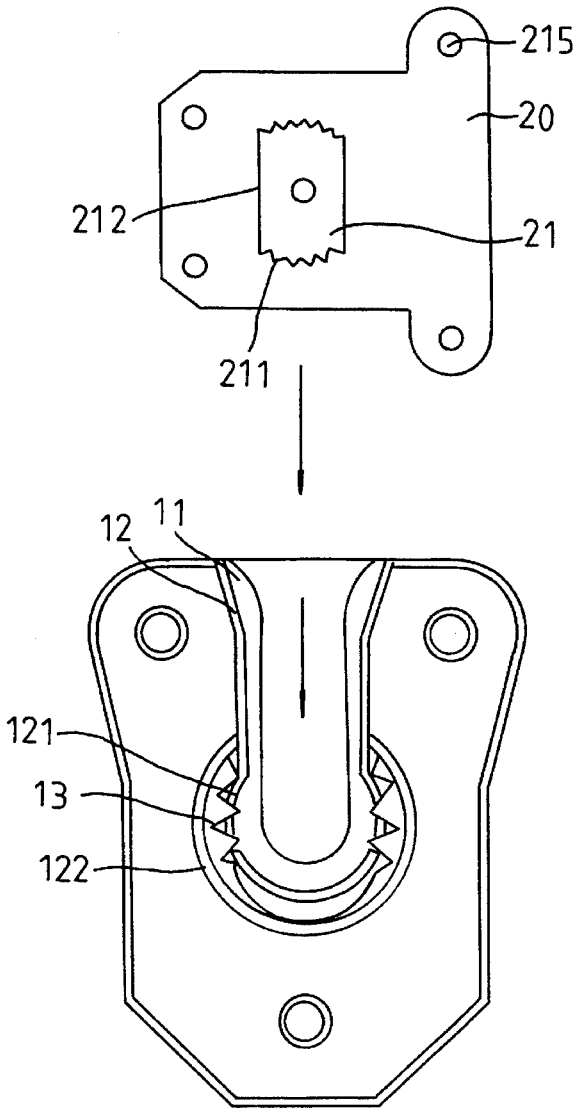
FIGS. 4, 5A and 5B show how the fixing plate is engaged with the body portion.
Figure 5A:
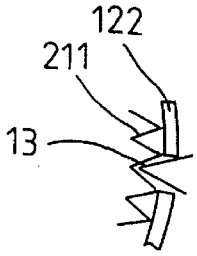
Figure 5B:
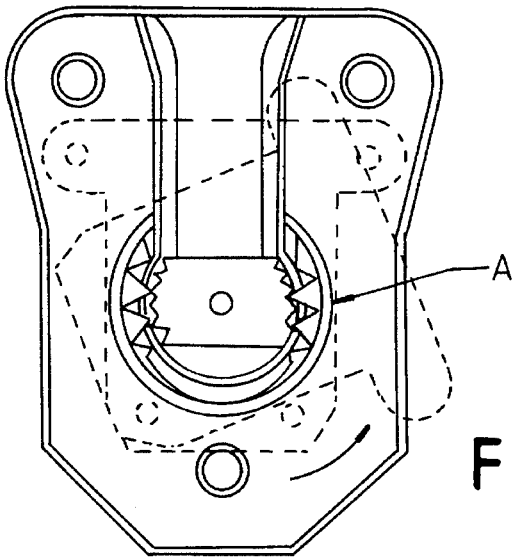
Figure 6A:
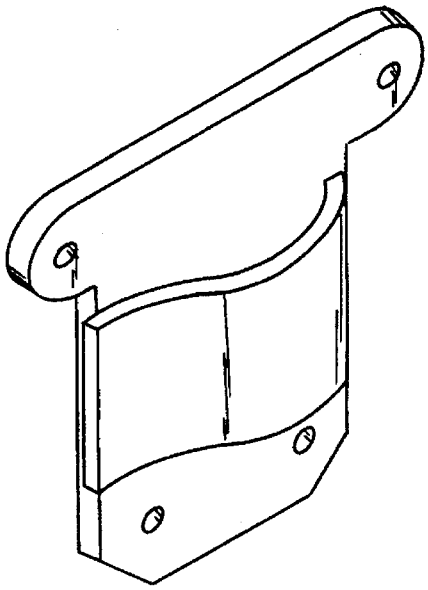
FIG. 6A shows the back side of the fixing plate.
Figure 6B:
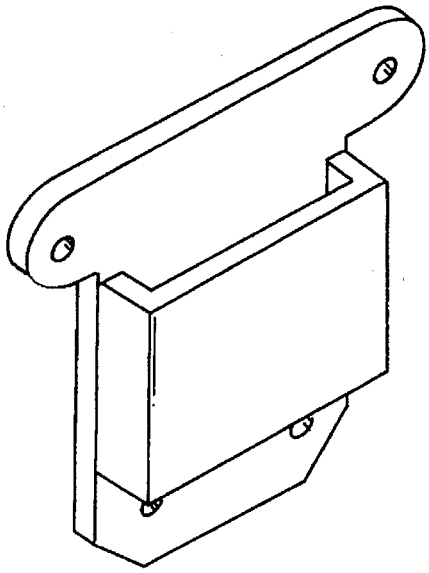
FIG. 6B shows another preferred back side of the fixing plate.

The fixing plate 20 has a toothed member 21 which is formed with teeth 211 at two opposite sides and a flat surface 212 at the other two opposite sides. As shown in FIGS. 4, 4A and 5, the fixing plate 20 is connected with the body portion 10 by engaging the toothed member 21 of the fixing plate 20 with the spring 13. When desired to disengage the fixing plate 20 from the body portion 10, simply turn the fixing plate 20 through an angle of 90 degrees and slide out the fixing plate 20. Further, the fixing plate 20 is formed with a hole 215 at four corners so that the fixing plate 20 can be fixedly mounted on any desired article by screws. In addition, the back side of the fixing plate 20 is provided a clamping member (see FIGS. 6A and 6B).

Figure 7:
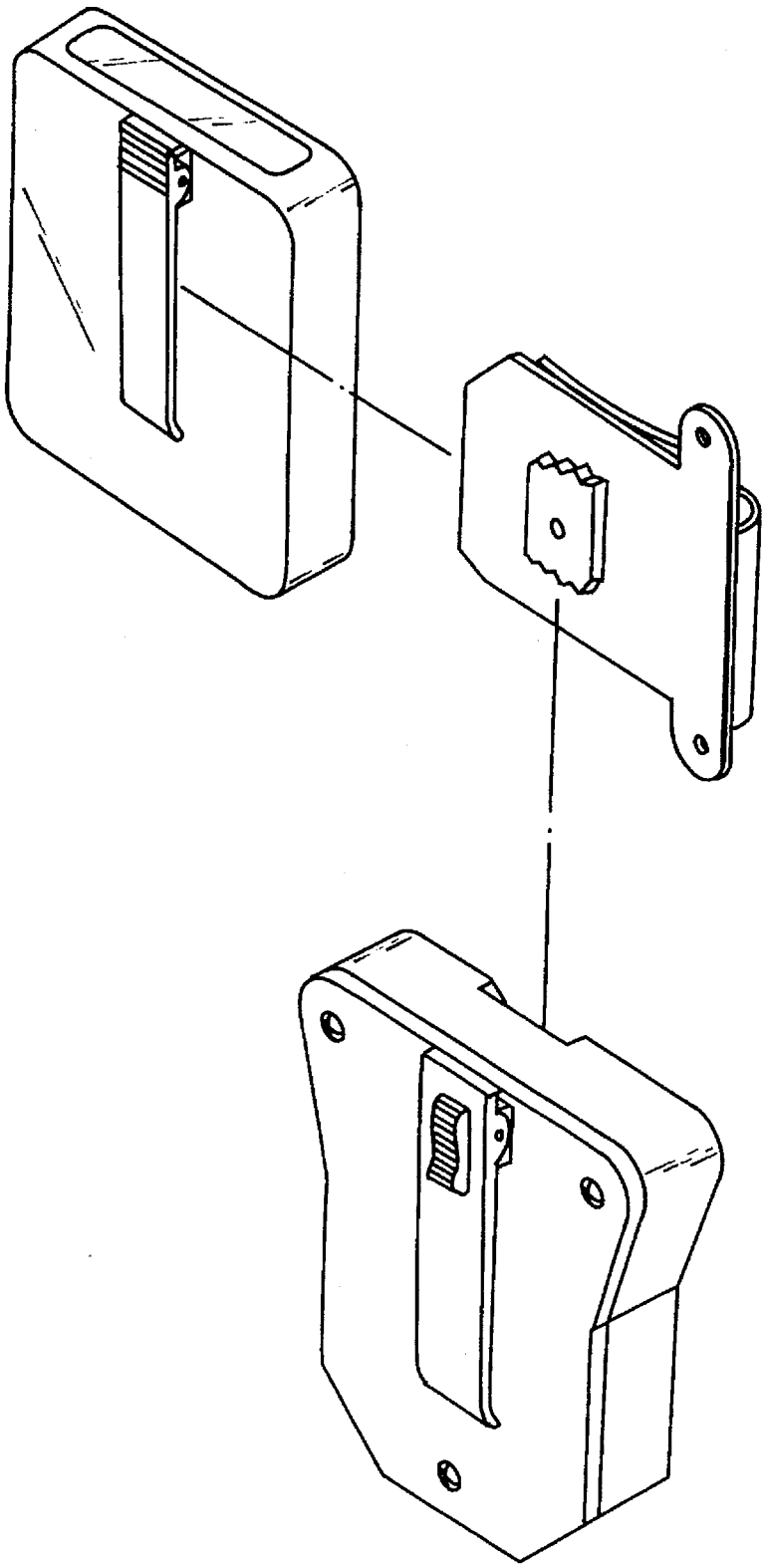
FIG. 7 is a first working view of the present invention.
Figure 8:
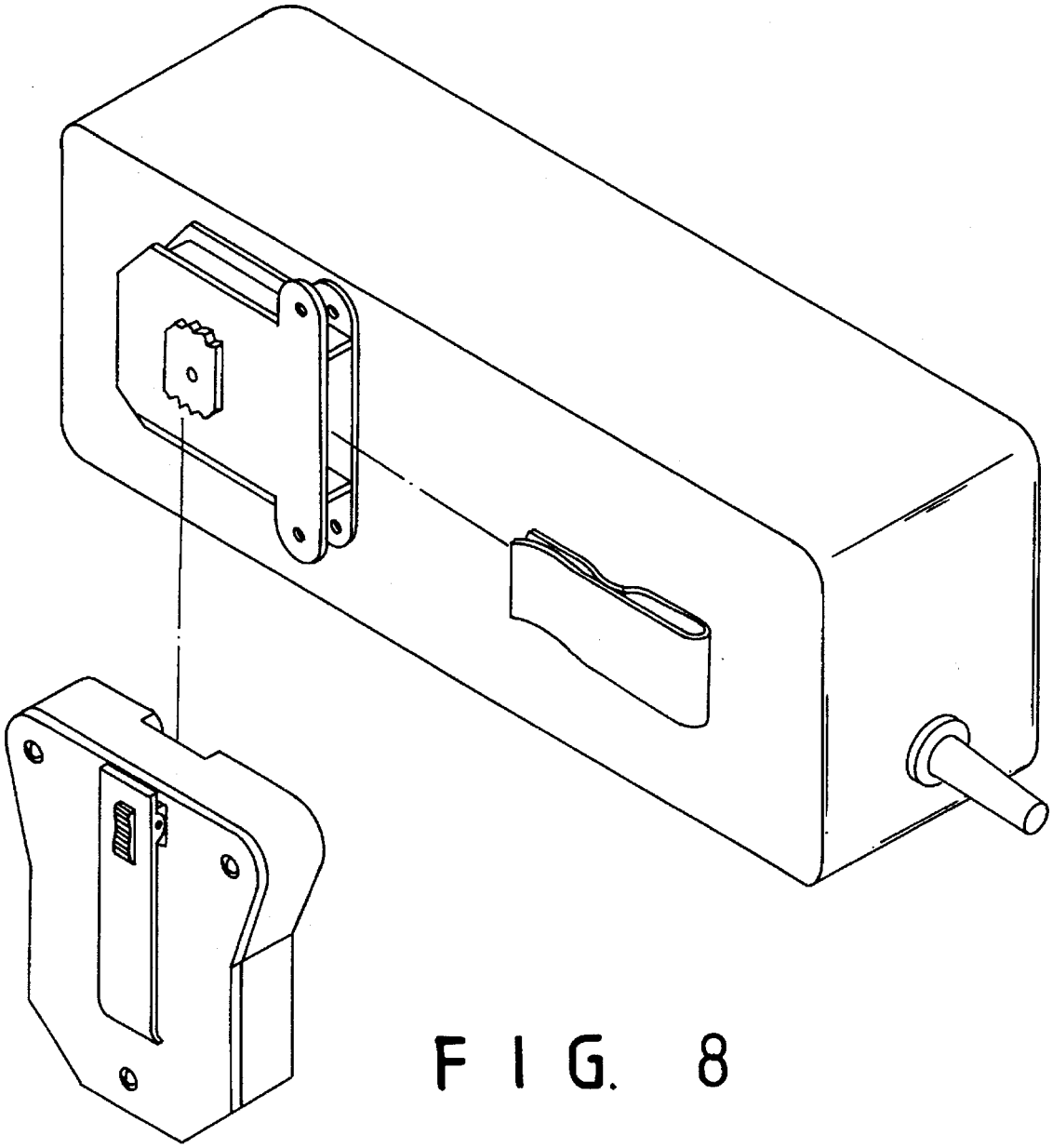
FIG. 8 is a second working view of the present invention.

FIGS. 7 and 8 show different applications of the present invention.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A multi-purpose fixing seat for belts comprising:

a body portion formed with a recess having a raised rack at both sides thereof, a plurality of protuberances between two portions of said raised rack, and a circular raised edge enclosing said protuberances;

a resilient member fitted between said protuberances and said circular raised edge;

a cover fixedly mounted on said body portion and pivotally connected with a clamping member, said clamping member provided on the top with a movable button which is connected with a rod member at the bottom of said clamping member, said cover having a lug adapted to receive said rod member; and a fixing plate having a toothed member formed with teeth at two opposite sides and a flat surface at the other two opposite sides, said toothed member being engaged with said resilient member.

* * * * *